US005486910A

United States Patent [19]

Harada

[11] Patent Number: 5,486,910

[45] Date of Patent: Jan. 23, 1996

[54] IMAGE FORMING APPARATUS HAVING PAPER FEEDING MECHANISM FOR FEEDING SHEET FROM SHEET A STORAGE PORTION TO AN IMAGE FORMING PORTION

[75] Inventor: Kentaro Harada, Yokohama, Japan

[73] Assignee: Kabushiki Kaisha Toshiba, Kawasaki, Japan

[21] Appl. No.: 201,242

[22] Filed: Feb. 24, 1994

[30] Foreign Application Priority Data

Mar. 26, 1993 [JP] Japan ..... 5-068907

[51] Int. Cl.[6] ..... G03G 15/00

[52] U.S. Cl. ..... 355/309; 271/246; 271/258.01; 271/9.01; 355/316

[58] Field of Search ..... 355/308, 309, 355/316, 317; 271/9, 10, 114, 109–110, 152–154, 226–227, 246, 256, 258

[56] References Cited

U.S. PATENT DOCUMENTS

| | | | |
|---|---|---|---|
| 4,790,524 | 12/1988 | Murakami et al. | 271/10 |
| 4,861,017 | 8/1989 | Yamamoto et al. | 271/258 |
| 4,898,375 | 2/1990 | Holtje | 271/246 |
| 5,199,694 | 4/1993 | Iseda | 271/9 |
| 5,240,242 | 8/1993 | Ando et al. | 271/118 |
| 5,324,015 | 6/1994 | Freitag | 271/9 |

FOREIGN PATENT DOCUMENTS 61-1337 1/1986 Japan .

*Primary Examiner*—A. T. Grimley
*Assistant Examiner*—Thu Dang
*Attorney, Agent, or Firm*—Foley & Lardner

[57] ABSTRACT

In an electronic copying machine, a paper feeding mechanism includes a paper supply roller, a reversal roller, and an aligning roller. The aligning roller and the reversal roller are rotated by a motor through first and second transmission mechanisms, respectively. The supply roller is rotated by the rotational force of the aligning roller through a third transmission mechanism. A first locking member is shifted by a first solenoid between a locking position, in which the first locking member engages the first transmission mechanism to interrupt the transmission of the driving force, and a transmission position, in which the first locking member is disengaged from the first transmission mechanism. A second locking member is shifted by a second solenoid between a first locking position, in which the second locking member interrupts the transmission of the driving force by the second transmission mechanism, and a second locking position, in which the second locking member interrupts the transmission of the driving force by the third transmission mechanism.

11 Claims, 9 Drawing Sheets

IMAGE FORMING APPARATUS HAVING PAPER FEEDING MECHANISM FOR FEEDING SHEET FROM SHEET A STORAGE PORTION TO AN IMAGE FORMING PORTION

BACKGROUND OF THE INVENTION

1. Field of the Invention

The present invention relates to an image forming apparatus, such as an electronic copying machine or laser printer, which is provided with a paper feeding mechanism.

2. Description of the Related Art

In general, an image forming apparatus, such as an electronic copying machine, comprises a photoconductive drum for use as an image carrier, which is rotatably arranged substantially in the center of an apparatus housing. A developing device, transfer device, separating device, cleaner, de-electrifier, and main charger are arranged successively around the drum, thus constituting an image forming mechanism. Arranged over the image forming mechanism is an optical system, which exposes the drum to an image read from an original document, thereby forming an electrostatic latent image on the surface of the drum.

Under the image forming mechanism are arranged a paper cassette, which is stored with a number of sheets for use as record media, and a paper feeding mechanism for delivering the sheets one after another from the cassette and feeding them to the image forming mechanism. A developer image formed on the photoreceptor drum is transferred to the surface of each sheet fed by means of the paper feeding mechanism.

The paper feeding mechanism comprises a U-turn transportation path for guiding the sheets from the paper cassette to the image forming mechanism and a pickup roller for taking out the sheets from the cassette and guiding them to the transportation path. Further, feed rollers are provided in the middle of the transportation path, and an aligning roller for aligning the sheets is located at the terminal end portion of the path.

Conventionally, the pickup roller, feed rollers, and aligning roller are driven by means of one common drive motor with the aid of drive belts, gear trains, etc. These rollers must be actuated or stopped with their respective predetermined timings. To attain this, spring clutches are connected individually to the rollers, and the predetermined drive timings are obtained by on-off-controlling the clutches by means of independent control mechanisms, such as solenoids.

In the paper feeding mechanism of the conventional image forming apparatus described above, however, the spring clutches and the control mechanisms, such as the solenoids, must be provided individually for the pickup roller, feed roller, and aligning roller. Thus, the feeding mechanism requires use of many components, thereby entailing high manufacturing costs, and the whole apparatus is heavy in weight and large-sized. Moreover, a complicated control system is needed to control a lot of solenoids.

SUMMARY OF THE INVENTION

The present invention has been contrived in consideration of these circumstances, and its object is to provide an image forming apparatus in which paper feeding means has a simpler construction such that the weight, installation space, and manufacturing costs of the whole apparatus can be reduced.

In order to achieve the above object, according to an image forming apparatus of the present invention, paper feeding means for feeding sheets from storage means stored with the sheets to image forming means includes a transportation path for guiding the sheets from the storage means to the image forming means, a first feed roller for delivering the sheets from the storage means to the transportation path, a second feed roller in the transportation path for feeding the sheets delivered thereto by the first feed roller, a third feed roller for aligning the sheet delivered thereto by the second feed roller and feeding the sheet to the image forming means, and drive means for rotating the first to third feed rollers. The drive means includes a drive source, first transmission means for transmitting the driving force of the drive source to the third feed roller in an interruptible manner, second transmission means for transmitting the driving force of the drive source to the second feed roller in an interruptible manner, third transmission means for transmitting the driving force of the third feed roller to the first feed roller in an interruptible manner, a first locking member movable between a locking position, in which the first locking member engages the first transmission means to interrupt the transmission of the driving force by the first transmission means, and a transmission position, in which the first locking member is disengaged from the first transmission means, first switching means for shifting the position of the first locking member between the locking position and the transmission position, a second locking member movable between a first locking position, in which the second locking member engages the second transmission means to interrupt the transmission of the driving force by the second transmission means, and a second locking position, in which the second locking member engages the third transmission means to interrupt the transmission of the driving force by the third transmission means, and second switching means for shifting the position of the second locking member between the first and second locking positions.

According to the arrangement described above, the third feed roller is driven by the drive source through the medium of the first transmission means, while the first feed roller is driven by means of the driving force of the third feed roller through the medium of the third transmission means. In other words, the first feed roller is driven by the drive source through the medium of the first and third transmission means, and is actuated and stopped in association with the third feed roller. Thus, the actuation and stoppage of the first and third feed rollers can be simultaneously controlled by controlling the transmission of the first transmission means by means of the first locking member. By controlling the power transmission of the third transmission means by means of the second locking member, moreover, the actuation and stoppage of the first feed roller can be controlled singly.

Accordingly, the operations of the first to third feed rollers can be controlled by controlling the operations of the first and second locking members. It is necessary only that one switching means, such as a solenoid, be provided for each of the first and second locking members, and the three feed rollers can be controlled by means of the two switching means.

Thus, in the apparatus of the invention, as compared with conventional ones, the switching means, such as solenoids, can be reduced in number to simplify the construction of the paper feeding means, so that the weight, installation space, and manufacturing costs of the whole apparatus can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

FIGS. 1 to 25 show an electronic copying machine according to one embodiment of the present invention, in which:

FIG. 1 is a sectional view schematically showing an arrangement of the copying machine, FIG. 2 is a sectional view schematically showing a drive system for the copying machine, FIG. 3 is a perspective view of a drive system for a paper feeding mechanism of an image forming apparatus according to the one embodiment of the invention, FIG. 4 is a sectional view schematically showing a paper feed path of the paper feeding mechanism and feed rollers, FIG. 5 is a side view schematically showing a drive control system for the paper feeding mechanism at the start of paper feeding operation, FIG. 6 is a block diagram showing the general configuration of the paper feeding mechanism, FIG. 7 is a side view schematically showing an operating state of the drive control system for the paper feeding mechanism established when a sheet is taken out by means of a pickup roller, FIG. 8 is a sectional view corresponding to FIG. 4, showing the way the sheet is taken out by means of the pickup roller, FIG. 9 is a side view schematically showing an operating state of the drive control system for the paper feeding mechanism established when a reversal roller is reached by the sheet, FIG. 10 is a sectional view corresponding to FIG. 4, showing the state in which the reversal roller is reached by the sheet, FIG. 11 is a side view schematically showing an operating state of the drive control system for the paper feeding mechanism established when the sheet is transported by means of the reversal roller, FIG. 12 is a sectional view corresponding to FIG. 4, showing the way the sheet is transported by means of the reversal roller, FIG. 13 is a side view schematically showing an operating state of the drive control system for the paper feeding mechanism established when the pickup roller is restored to its initial position, FIG. 14 is a sectional view corresponding to FIG. 4, showing the state in which the pickup roller is restored to the initial position, FIG. 15 is a side view schematically showing an operating state of the drive control system for the paper feeding mechanism established when the sheet is transported by means of the reversal roller after the pickup roller is restored to the initial position, FIG. 16 is a sectional view corresponding to FIG. 4, showing the way the sheet is transported by means of the reversal roller after the pickup roller is restored to the initial position, FIG. 17 is a side view schematically showing an operating state of the drive control system for the paper feeding mechanism established when the aligning roller is reached by the sheet, FIG. 18 is a sectional view corresponding to FIG. 4, showing the aligning roller is reached by the sheet, FIG. 19 is a side view schematically showing an operating state of the drive control system for the paper feeding mechanism established when the sheet is transported by means of the reversal roller and the aligning roller, FIG. 20 is a sectional view corresponding to FIG. 4, showing the way the sheet is transported by means of the reversal roller and the aligning roller, FIG. 21 is a side view schematically showing an operating state of the drive control system for the paper feeding mechanism established when the trailing end of the sheet is separated from the reversal roller, FIG. 22 is a sectional view corresponding to FIG. 4, showing the state in which the trailing end of the sheet is off the reversal roller, and FIG. 23 is a flow chart for illustrating the operation of the paper feeding mechanism;

FIG. 24 is a side view schematically showing a drive control system for a paper feeding mechanism according to a modification of the invention; and FIG. 25 is a side view showing an alternative operating state of the drive control system for the paper feeding mechanism according to the modification.

DETAILS DESCRIPTION OF THE PREFERRED EMBODIMENTS

An embodiment of the present invention applied to an electronic copying machine will now be described with reference to the accompanying drawings.

Figure 1:
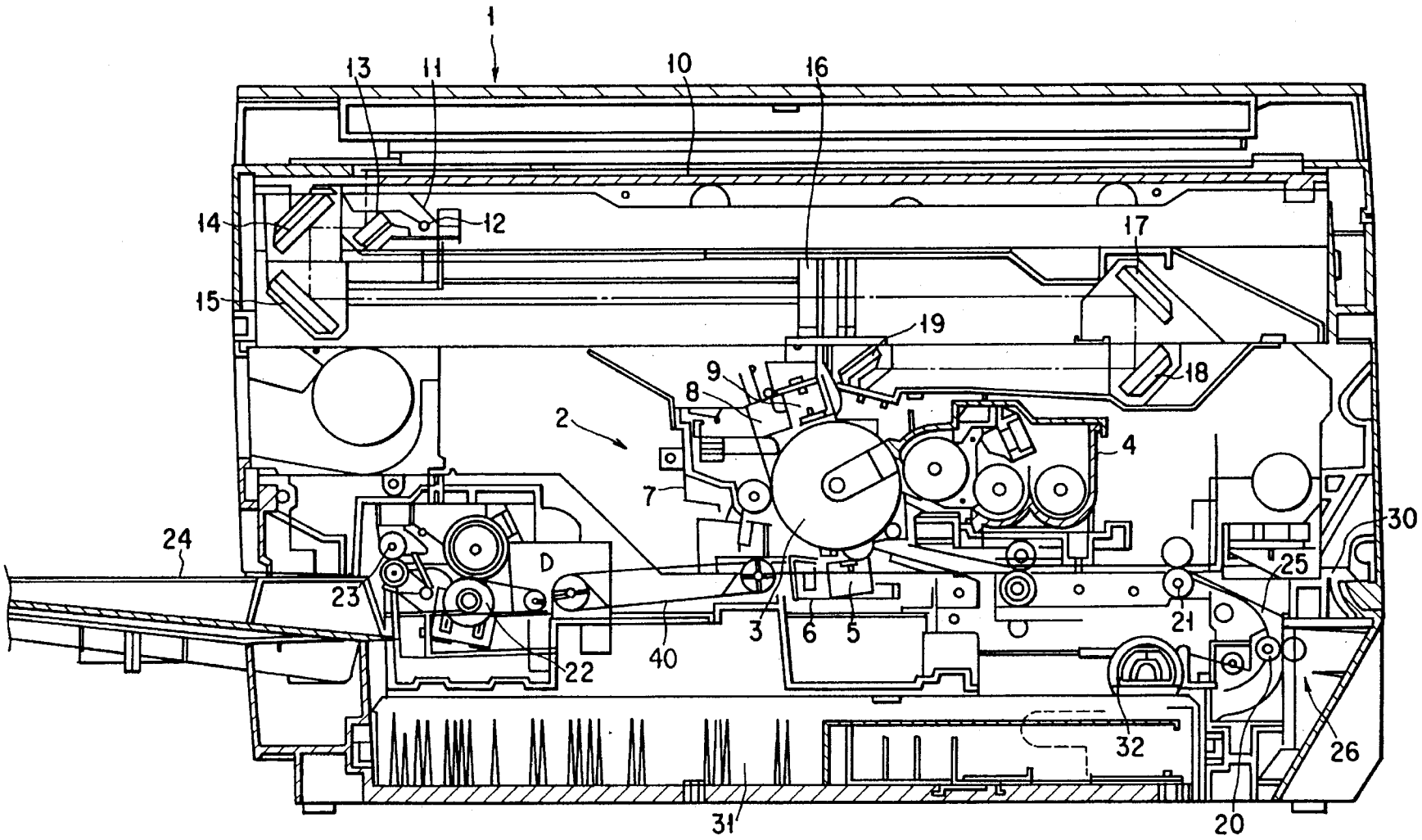
Figure 2:
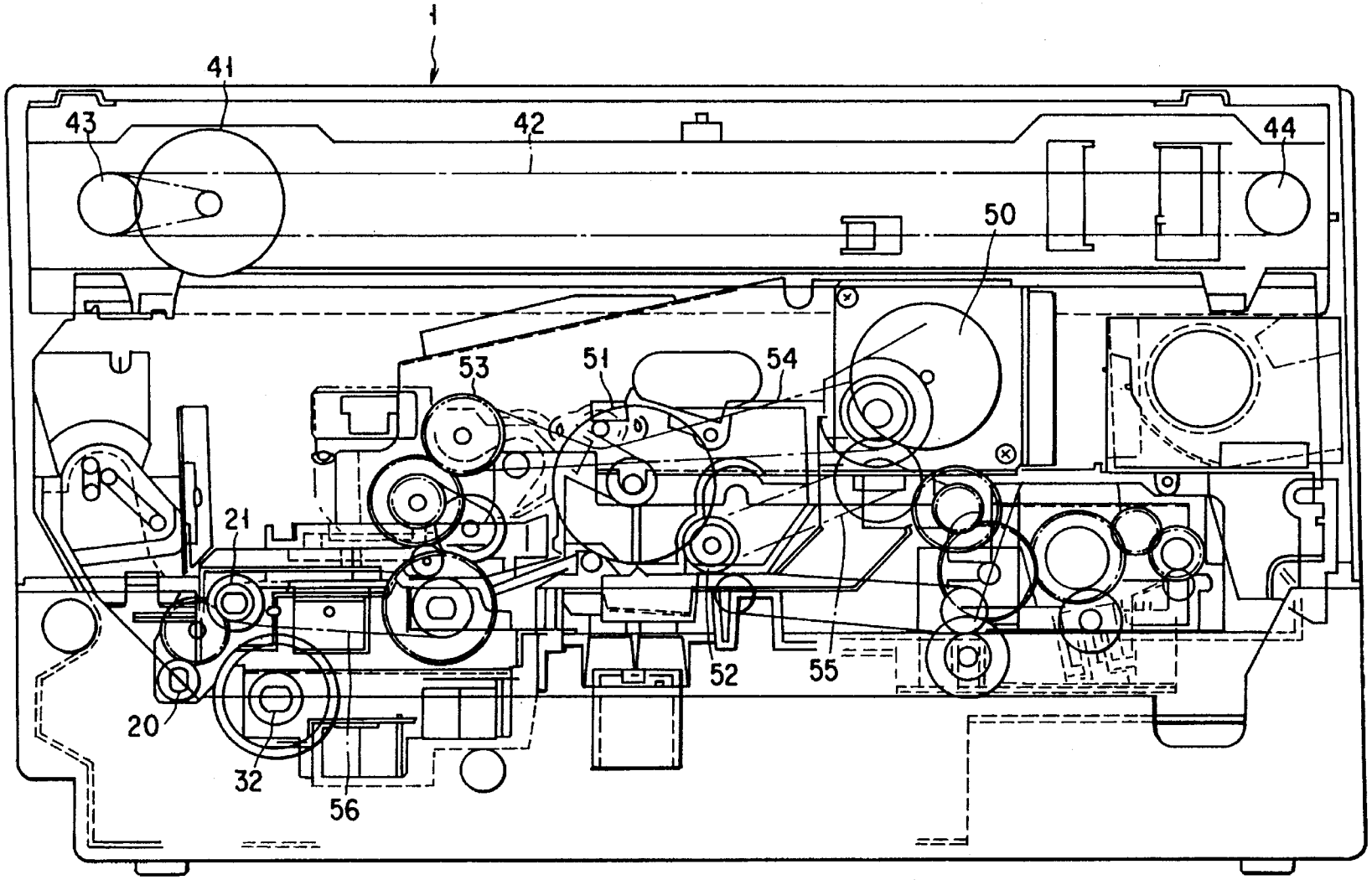

As shown in FIGS. 1 and 2, the electronic copying machine comprises a housing 1, and a photoconductive drum 3 for use as an image carrier is rotatably arranged substantially in the center of the housing 1. A developing device 4, transfer device 5, separating device 6, cleaner 7, de-electrifier 8, and main charger 9 are arranged successively around the drum 3, thus constituting an image forming section 2.

Arranged over the image forming section 2 is an optical exposure system, which includes an exposure lamp 12 backed by a reflector 11, first, second and third reflector mirrors 13, 14 and 15, a lens 16, fourth, fifth, and sixth reflector mirrors 17, 18 and 19, etc. A document table 10, which is formed of transparent glass, is located at the top of the apparatus housing 1. An image of an original document (not shown) placed on the table 10 is scanned by means of the optical exposure system. The photoconductive drum 3, which is uniformly charged by means of the main charger 9, is exposed to the light reflected from the document, whereby an electrostatic latent image is formed on the surface of the drum. The latent image is developed into a developer image by means of the developing device 4.

Located at the bottom of the housing 1 is a paper cassette 31 which is stored with a number of copying sheets P for use as transfer media. The sheets P are delivered one after another from the paper cassette 31 to be fed to the image forming section 2 by means of a paper feeding mechanism 26, which will be mentioned later. Then, the developer image on the photoconductive drum 3 is transferred to the surface of each fed sheet P by means of the transfer device 5.

After the transfer by means of the transfer device 5, the sheet P is separated by AC corona discharge from the separating device 6, and is transported to a fixing device 22 by means of a conveyor belt 40. After the developer image is fixed to the sheet P by fusion by means of the fixing device 22, the sheet P is discharged onto a receiving tray 24 by a discharge roller pair 23.

The developer remaining on the photoconductive drum 3 after the transfer of the developer image to the sheet P and the separation is removed by means of the cleaner 7. Thereafter, the potential of the drum 3 is lowered to a predetermined level or below by means of the de-electrifier 8, to be ready for the next cycle of copying operation.

As shown in FIG. 2, the electronic copying machine comprises, as a drive mechanism for the optical exposure system, a scanning motor 41 and a first drive belt 42 stretched between pulleys 43 and 44 and driven by the motor 41. The exposure lamp 12 and the first, second and third reflector mirrors 13, 14 and 15 are moved by means of the belt 42.

Further, the electronic copying machine comprises a main motor 50 as a drive source for the image forming section 2. The motor 50 drives a drum gear 51 of the photoconductive drum 3, a drive gear 52 of the cleaner 7 in mesh with the gear 51, and a drive gear 53 of the developing device 4 with the aid of a second drive belt 54. The driving force of the motor 50 is transmitted to the fixing device 22 by means of the gear 52 and a third drive belt 55. The main motor 50 also constitutes a drive source for the paper feeding mechanism 26 (mentioned later), and its driving force is transmitted to the mechanism 26 through the developing device 4.

The following is a detailed description of the paper feeding mechanism 26 for feeding the sheets P from the paper cassette 31 to the image forming section 2.

As shown in FIGS. 1 to 4, the paper feeding mechanism 26 comprises a U-turn transportation path 25 and a paper-supply roller 32. The path 25 serves to reverse and guide the sheets P, delivered from the paper cassette 31, into the image forming section 2. The roller 32 takes out the sheets p one by one from the cassette 31 and feeds them into the transportation path 25. The roller 32, which is in the form of a semicircular column, constitutes a first feed roller. Arranged in the middle portion of the path 25 are a reversal roller 20, for use as a second feed roller, and a roller **20*b* in rolling contact with the roller 20. Arranged at the terminal end portion of the path 25 are an aligning roller 21, for use as a third feed roller, and a roller 21*b* in rolling contact with the roller 21. Each sheet P is taken out from the paper cassette 31 by the paper-supply roller 32, and is delivered to the aligning roller 21 via the reversal roller 20 in the transportation path 25. After it is aligned by the rollers 21 and 21*b*, the sheet P is transported to the image forming section 2**.

Figure 4:
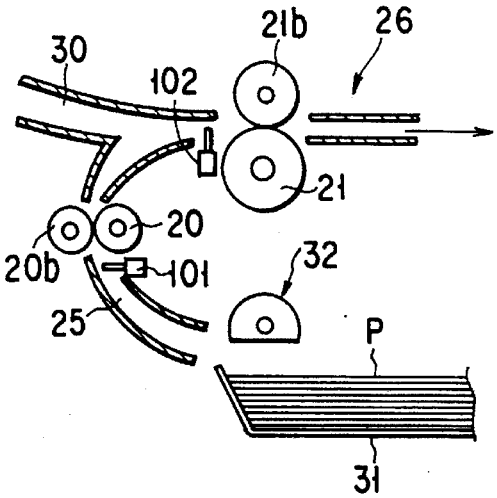

As shown in FIGS. 1 and 4, a manual paper feed aperture 30 is provided between the reversal roller 20 and the aligning roller 21 such that sheets, not the ones delivered from the paper cassette 31, can be externally fed into the apparatus and guided to the aligning roller 21 through the aperture 30.

Figure 3:
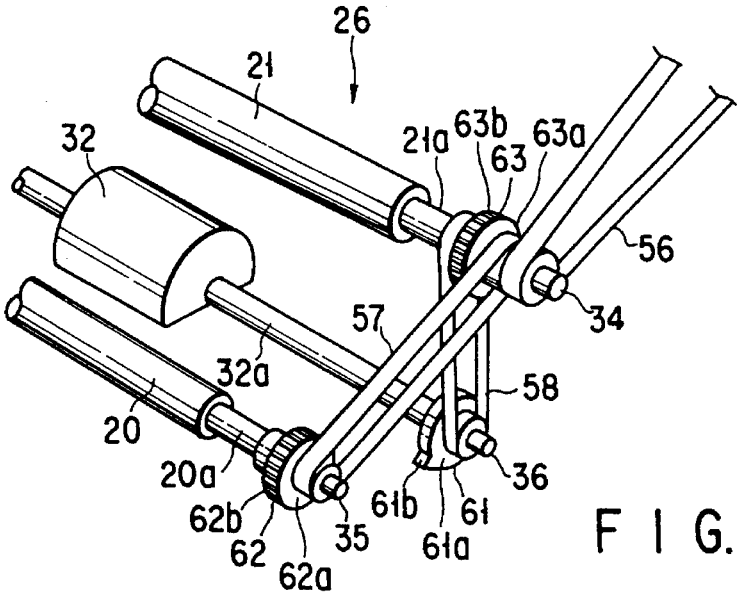

As shown in FIG. 3, a support shaft **21*a* of the aligning roller 21 is connected to a first drive shaft 34 through a first one-way clutch 63, and the shaft 34 is connected to the main motor 50 (see FIG. 2) through a drive belt 56, the developing device 4, and the drive belt 54. Thus, the aligning roller 21 is rotated by the motor 50 through the medium of the clutch 63, shaft 34, belt 54, etc. The first one-way clutch 63 includes a wheel 63*a* which can rotate integrally with the support shaft 21*a*, and a number of latches 63*b* are arranged at regular intervals on the outer circumferential surface of the wheel 63*a***.

A support shaft **20*a* of the reversal roller 20 is connected to a second drive shaft 35 through a second one-way clutch 62, and a drive belt 57 is stretched between the first and second drive shafts 34 and 35. Thus, the reversal roller 20 is rotated by the main motor 50 through the medium of the clutch 62, shaft 35, belt 57, shaft 34 and belt 56. The second one-way clutch 62 includes a wheel 62*a* which can rotate integrally with the support shaft 20*a*, and a number of latches 62*b* are arranged at regular intervals on the circumferential surface of the wheel 62*a***.

A support shaft **32*a* of the paper-supply roller 32 is connected to a third drive shaft 36 through a third one-way clutch 61, and a drive belt 58 is stretched between the drive shaft 36 and the support shaft 21*a* of the aligning roller 21. Thus, the driving force of the aligning roller 21 is transmitted to the paper-supply roller 32 through the clutch 61, shaft 36, and belt 58, and the paper-supply roller is rotated in association with the aligning roller. The third one-way clutch 61 includes a wheel 61*a* which can rotate integrally with the support shaft 32*a*, and an engaging projection 61*b* is formed on the circumferential surface of the wheel 61*a***.

Figure 5:
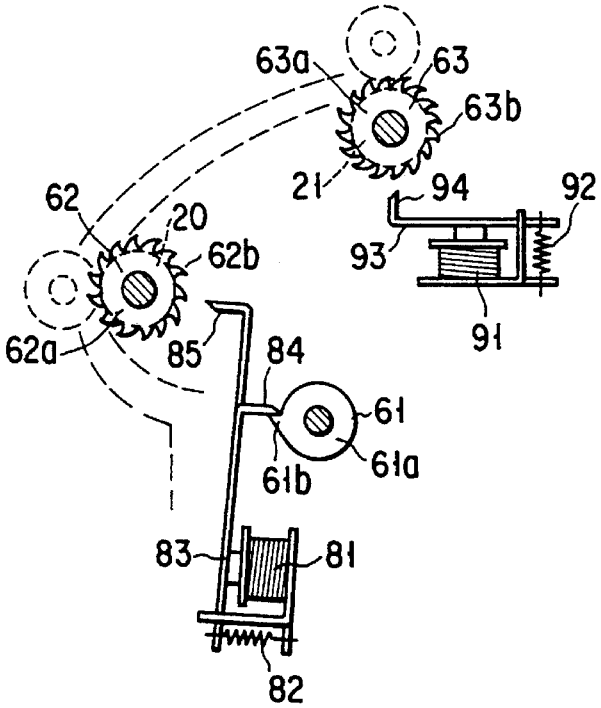

As shown in FIG. 5, the paper feeding mechanism 26 is provided with a control mechanism for controlling the rotation and stoppage of the paper-supply roller 32, reversal roller 20, and aligning roller 21. The control mechanism comprises first and second locking levers 93 and 83 and first and second solenoids 91 and 81 for shifting the levers 93 and 83, respectively. The first lever 93 has a pawl 94 which can engage each latch **63*b* of the first one-way clutch 63. The second lever 83 has pawls 85 and 84 which can engage each latch 62*b* of the second one-way clutch 62 and the engaging projection 61*b* of the third one-way clutch 61**, respectively.

The first locking lever 93 is rockable between a locking position, in which the pawl 94 engages one of the latches **63*b*, and a transmission position (shown in FIG. 5), in which the pawl 94 is disengaged from the latches 63*b*. The lever 93 is urged toward the locking position by means of a spring 92. The first solenoid 91 has a plunger which is connected to the locking lever 93. When the solenoid 91 is excited, it moves the lever 93 to the transmission position. As the pawl 94 engages one of the latches 63*b* in the locking position, the wheel 63*a* is restrained from rotating, and the transmission of the driving force to the aligning roller 21 is interrupted, that is, the roller 21** is stopped.

The second locking lever 83 is located between the second and third one-way clutches 62 and 61, and the pawls 84 and 85 protrude in opposite directions from the lever 83. The lever 83 is rockable between a first locking position, in which the pawl 85 engages one of the latches **62*b* of the second clutch 62, and a second locking position (shown in FIG. 5), in which the pawl 84 engages the engaging projection 61*b* of the third clutch 61. Normally, the lever 83 is urged toward the first locking position by means of a spring 82. The second solenoid 81 has a plunger which is connected to the locking lever 83. When the solenoid 81 is excited, it moves the lever 83** to the second locking position.

As the pawl 85 engages one of the latches **62*b* of the second one-way clutch 62** in the first locking position (FIG.

7), the wheel 62*a* is restrained from rotating, and the transmission of the driving force to the reversal roller 20 is interrupted, that is, the roller 20 is stopped. As the pawl 84 engages the engaging projection 61*b* in the second locking position, the wheel 61*a* is restrained from rotating, and the transmission of the driving force to the paper-supply roller 32 is interrupted, that is, the roller 32 is stopped.

As shown in FIG. 4, a first paper sensor 101 is located on the upper-course side of the reversal roller 20 with respect to the feed direction of the sheets P. The sensor 101 detects the arrival of each sheet P from the paper cassette 31 at the roller 20. A second paper sensor 102 is located on the upper-course side of the aligning roller 21 with respect to the feed direction of the sheets P. The sensor 102 detects the arrival of each sheet P from the reversal roller 20 at the roller 21.

Figure 6:
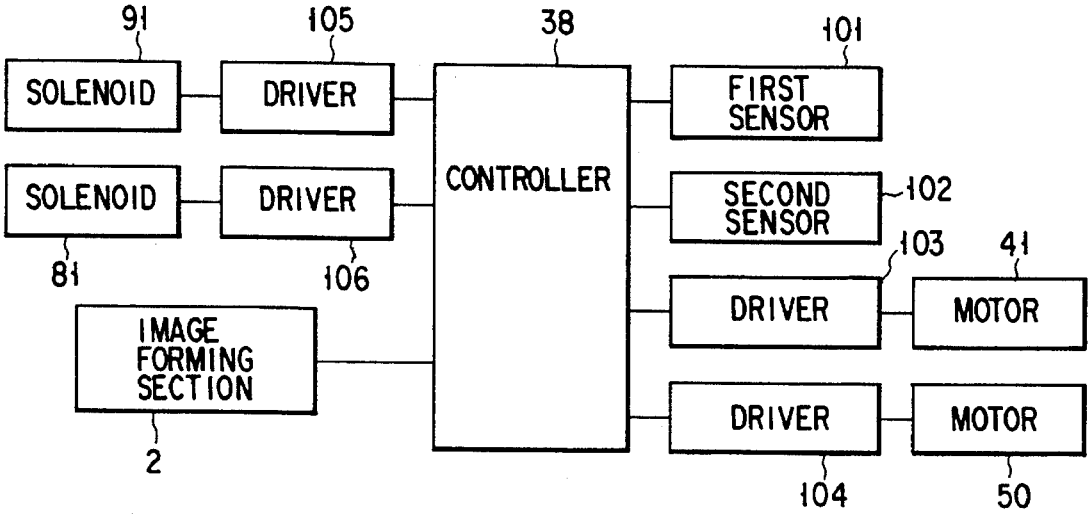

As shown in FIG. 6, the electronic copying machine comprises a controller 38 which controls the operations of the image forming section 2 and the paper feeding mechanism 26. The first and second sensors 101 and 102 are connected to the controller 38. Further, the controller 38 is connected with the scanning motor 41 and the main motor 50 through drivers 103 and 104, respectively, and also with first and second solenoids 91 and 81 through drivers 105 and 106, respectively.

Referring not to FIGS. 4 to 23, the paper feeding operation of the electronic copying machine constructed in this manner will be described.

In the state before the paper is fed, as shown in FIGS. 4 and 5, the first and second solenoids 91 and 81 are excited, and the first and second locking levers 93 and 83 are held in the transmission position and the second locking position, respectively, resisting the urging forces of their corresponding springs 92 and 82. Thereupon, the aligning roller 21 and the reversal roller 20 are kept in a rotatable state such that the driving force from the main motor 50 can be transmitted thereto. As the pawl 84 of the second locking lever 83 engages the engaging projection 61*b* of the third one-way clutch 61, in contrast with this, the paper-supply roller 32 is brought to a nonrotatable state in which the transmission of the driving force is interrupted.

In this state, moreover, a flat portion of the paper-supply roller 32 faces the sheets P in the paper cassette 31 at a distance therefrom.

Figure 7:
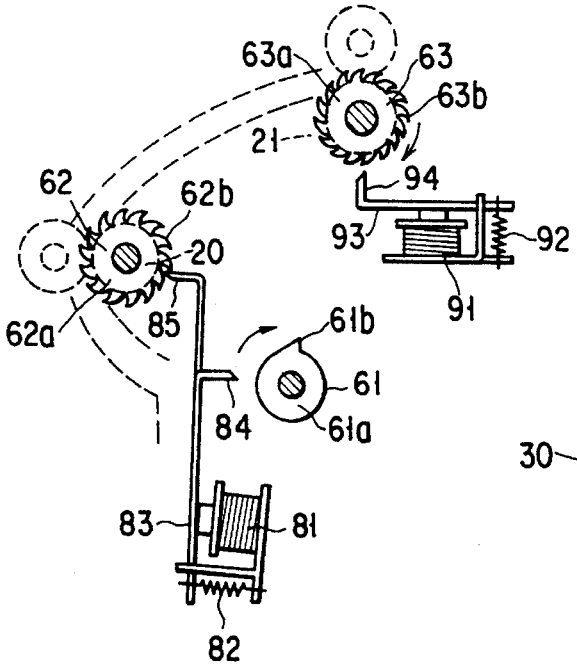
Figure 8:
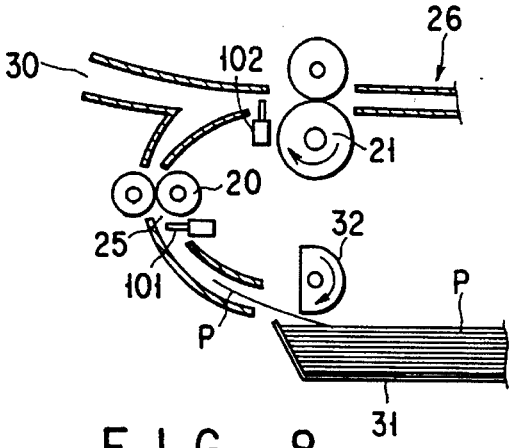

When the paper feeding operation is started, only the second solenoid 91 is de-energized. Thereupon, the second locking lever 83 is rocked to the first locking position by the spring 82, as shown in FIGS. 7 and 8. As a result, the pawl 84 is disengaged from the engaging projection 61*b* of the third one-way clutch 61, thereby allowing the paper-supply roller 32 to rotate, and the pawl 85 engages one of the latches 62*b* of the second one-way clutch 62, thereby restraining the reversal roller 20 from rotating.

When the main motor 50 is operated in this state, the aligning roller 21 is rotated through the medium of the first clutch 63, and the rotatory force of the roller 21 is transmitted to the paper-supply roller 32 through the third clutch 61. Accordingly, the roller 32 rotates to pick up a first sheet P from the paper cassette 31 and feeds it to the transportation path 25, as shown in FIG. 8.

Figure 9:
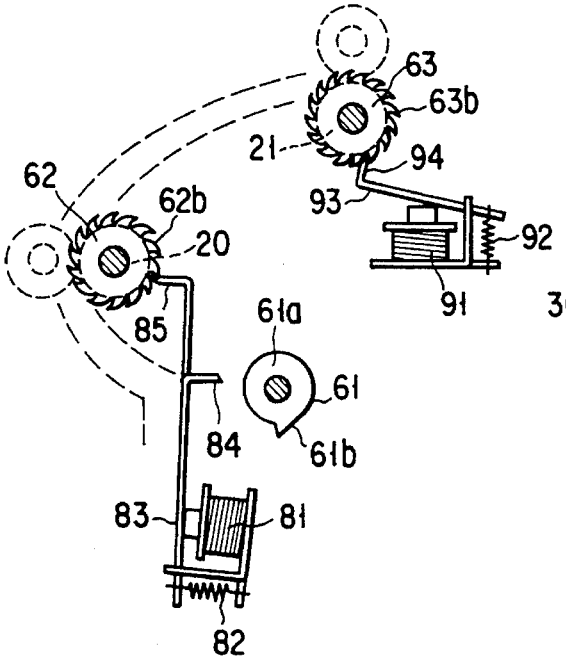
Figure 10:
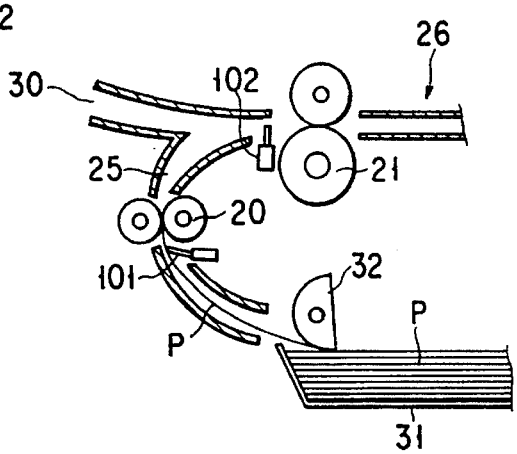

When the leading end of the sheet P delivered from the paper cassette 31 reaches the reversal roller 20, as shown in FIGS. 9 and 10, and if this arrival is detected by the first sensor 101, the first solenoid 91 is de-energized, so that the first locking lever 93 is rocked to the locking position. As a result, the pawl 94 engages one of the latches 63*b* of the first clutch 63, thereby stopping the rotation of the wheel 63*a* and the aligning roller 21. As the roller 21 is stopped in this manner, the transmission of the driving force to the paper-supply roller 32 is interrupted, so that the roller 32 is also stopped. Thus, the rotation of every roller is stopped. At this time, the sheet P is aligned in a manner such that its leading end abuts against the reversal roller 20.

Figure 11:
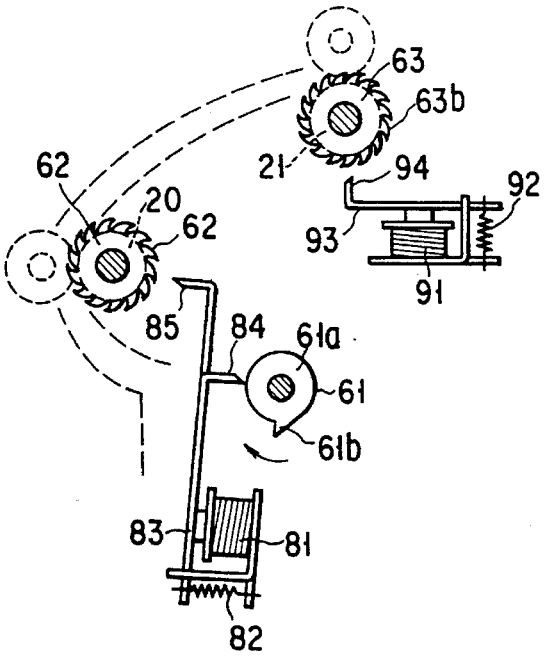
Figure 12:
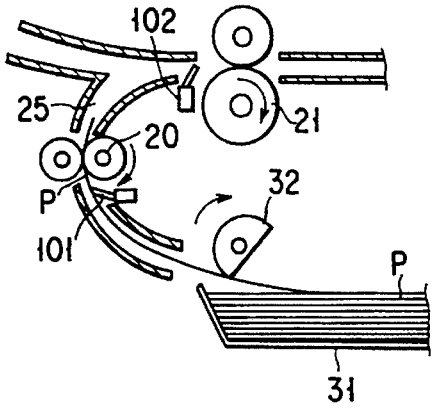

Subsequently, both the first and second solenoids 91 and 81 are excited, so that the first and second locking levers 93 and 83 are moved to a release position and the second locking position, respectively, as shown in FIGS. 11 and 12. Thereupon, the pawls 94 and 85 of the locking levers 93 and 83 are disengaged from the first and second clutches 63 and 62, respectively, so that the aligning roller 21 and the reversal roller 20 are allowed to rotate. As a result, the sheet P is transported to the roller 21 by the roller 20.

Although the pawl 84 of the second locking lever 83 abuts against the circumferential surface of the wheel 61*a* of the third clutch 61, there is no possibility of the wheel 61*a* being immediately restrained from rotating, since the wheel is provided with the only one engaging projection 61*b*. Thus, the wheel 61*a* and the paper-supply roller 32 rotate in association with the aligning roller 21 until the projection 61*b* engages the pawl 84, and in the meantime, the roller 32 transports the sheet P toward the reversal roller 20.

Figure 13:
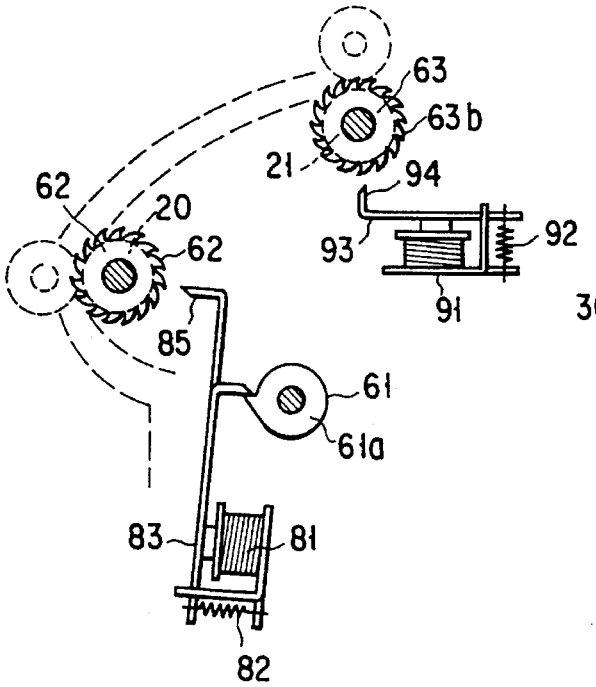
Figure 14:
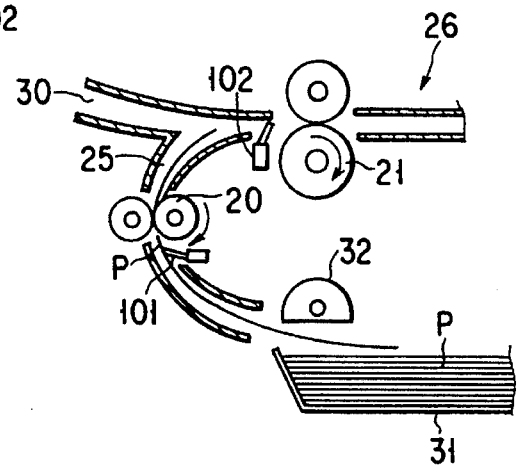

When the engaging projection 61*b* of the third clutch 61 engages the pawl 84 of the second locking lever 83, as shown in FIGS. 13 and 14, the rotation of the wheel 61*a* and the paper-supply roller 32 is stopped. At this point of time, the roller 32 is restored to its initial position, and stops in a state such that it is not in contact with any of the sheets P in the paper cassette 31. The aligning roller 21 and the reversal roller 20 continue to be rotated, and the sheet P is transported by the reversal roller without touching the paper-supply roller 32.

Figure 15:
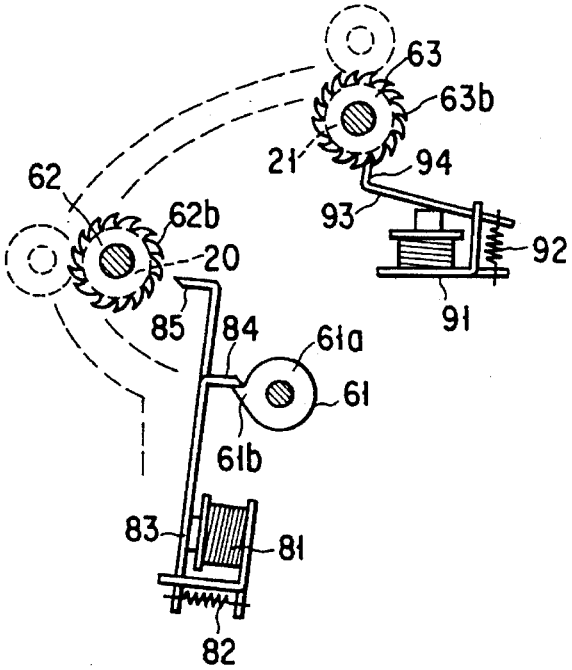
Figure 16:
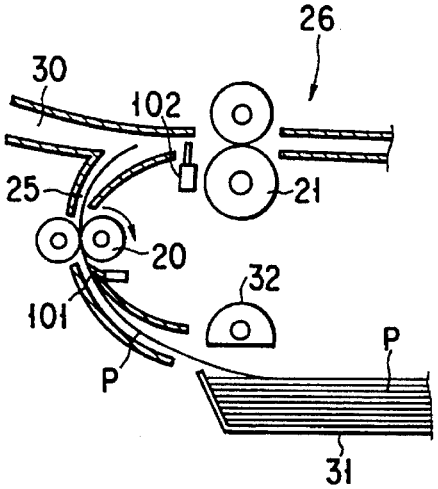

Then, the rotation of the aligning roller 21 is stopped by de-energizing the first solenoid 91 to allow the pawl 94 of the first locking lever 93 to engage one of the latches 63*b* of the first one-way clutch 63, as shown in FIGS. 15 and 16. The sheet P is transported to the stopped aligning roller 21 by driving the reversal roller 20 only.

Figure 17:
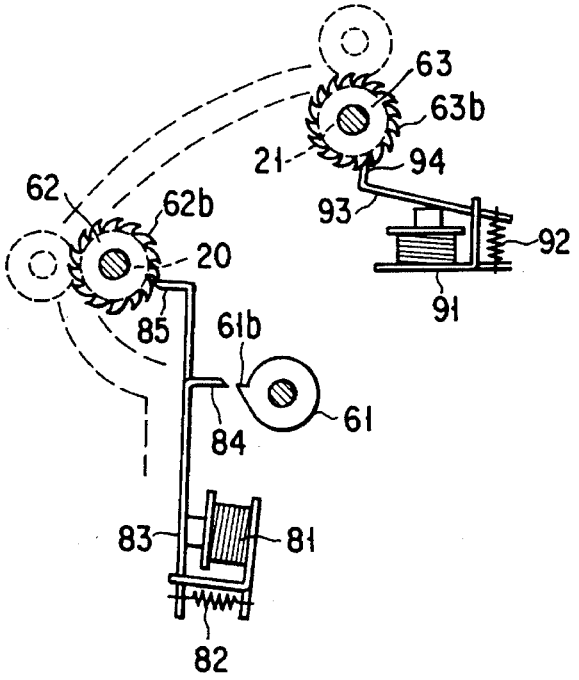
Figure 18:
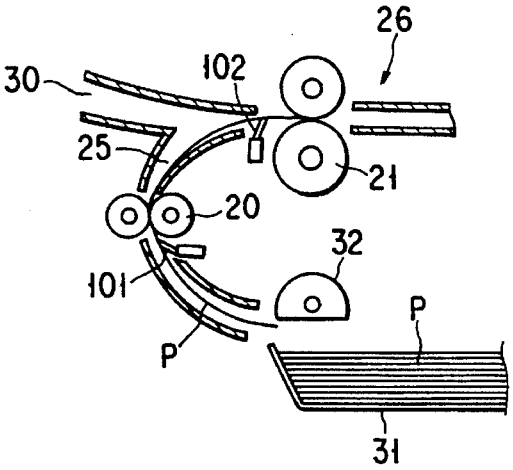

When the leading end of the sheet P reaches the aligning roller 21, as shown in FIGS. 17 and 18, and if this arrival is detected by the second sensor 102, the sheet P is advanced so as to be slightly bent as the reversal roller 20 rotates with the first solenoid 91 kept de-energized and the aligning roller 21 restrained from rotating. Thereafter, the second solenoid 81 is de-energized to allow the second locking lever 83 to move to the first locking position, so that the rotation of the reversal roller 20 is stopped. Thus, the sheet P is aligned in a manner such that its leading end abuts against the aligning roller 21.

Figure 19:
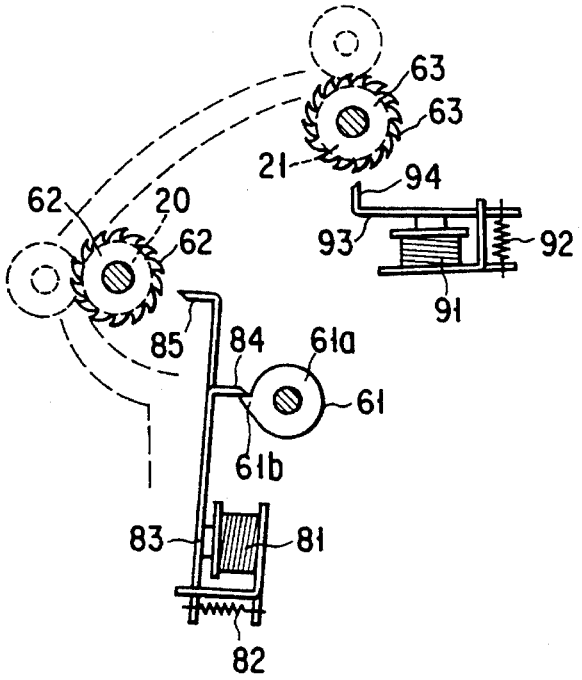
Figure 20:
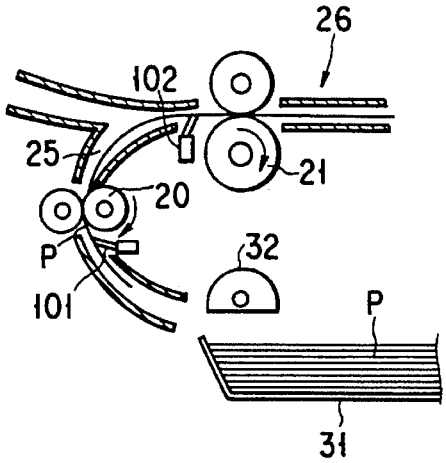

Thereafter, both the first and second solenoids 91 and 81 are excited, so that the aligning roller 21 and the reversal roller 20 are allowed to rotate, as shown in FIGS. 19 and 20, and the sheet P is transported to the image forming section 2.

Figure 21:
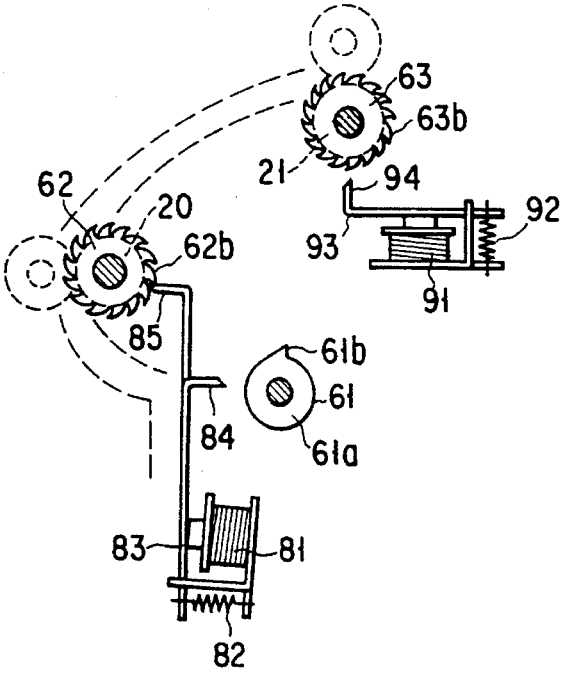
Figure 22:
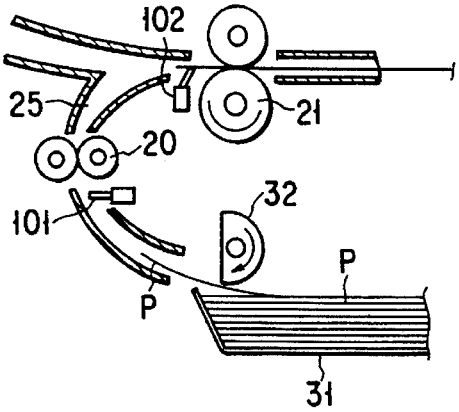

When the trailing end of the sheet P passes the reversal roller 20, as shown in FIGS. 21 and 22, and if this passage is detected by the first sensor 101, the second solenoid 81 is de-energized, so that the roller 20 is stopped. At the same time, the paper-supply roller 32 is allowed to rotate, thereby picking up a second sheet P from the paper cassette 31. After this, the same processes of operation as aforesaid are repeated to execute production of a desired number of copies.

In manually feeding a sheet from the manual paper feed aperture 30, the paper-supply roller 32 is restrained from rotating by means of the second locking lever 83 with the second solenoid kept energized, so that the delivery of the sheets P from the paper cassette 31 is prevented. On the other hand, the first solenoid 91 is de-energized to restrain the aligning roller 21 from rotating. In this state, the sheet P is delivered directly to the side of the roller 21.

When the leading end of the sheet P delivered to the aligning roller 21 is detected by means of the second sensor 102, the first solenoid 91 is energized, so that the roller 21 is allowed to rotate. As a result, the sheet P is fed into the image forming section 2 in the apparatus housing 1 by the aligning roller 21.

According to the electronic copying machine constructed in this manner, the aligning roller 21 is driven by the main motor 50 through the medium of first one-way clutch 63, while the paper-supply roller 32 is driven by means of the driving force of the aligning roller through the medium of the third one-way clutch 61. In other words, the roller 32 is driven by the motor 50 through the medium of the first and third clutches 63 and 61, and is actuated and stopped in association with the aligning roller 21. Thus, the actuation and stoppage of the rollers 21 and 32 can be simultaneously controlled by controlling the transmission of the first clutch 63 by means of the first locking lever 93. By controlling the power transmission of the third clutch 61 by means of the second locking lever 83, moreover, the actuation and stoppage of the paper-supply roller 32 can be controlled singly.

Accordingly, the operations of the aligning roller 21, reversal roller 20, and paper-supply roller 32 can be controlled by controlling the operations of the first and second locking levers 93 and 83. It is necessary only that one solenoid serving as the switching means be provided for each of the first and second locking levers 93 and 83, and the three rollers can be controlled by means of the two solenoids 91 and 81.

Thus, in the apparatus of the invention, as compared with conventional ones, the switching means, such as the solenoids, can be reduced in number to simplify the construction of the paper feeding mechanism, so that the weight, installation space, and manufacturing costs of the whole apparatus can be reduced.

It is to be understood that the present invention is not limited to the embodiment described above, and that various changes and modifications may be effected therein by one skilled in the art without departing from the scope or spirit of the invention.

In the embodiment described above, for example, the arrival of the sheet P at the reversal roller is detected by means of the first sensor 101. Since the distance between the paper-supply roller and the reversal roller is relatively short, however, the arrival of the sheet P may be detected by grasping the slip factor of the paper-supply roller on the sheet without using any sensor.

Figure 24:
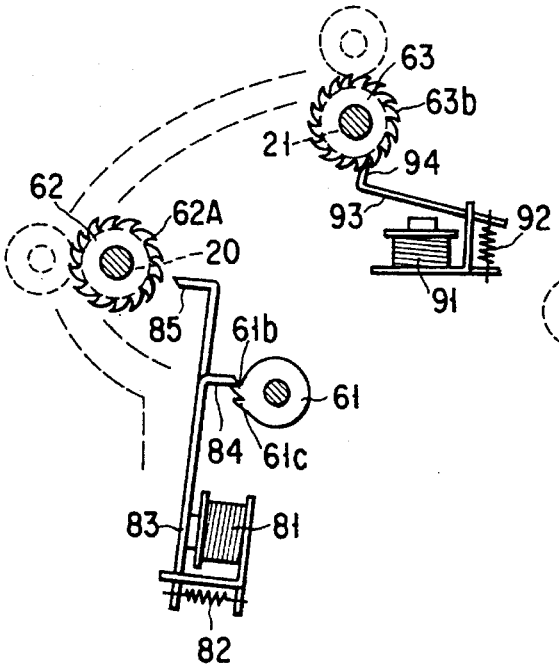

As shown in FIG. 24, moreover, the wheel 61*a* of the third one-way clutch 61 for transmitting the driving force to the paper-supply roller 32 may be provided with first and second engaging projections 61*b* and 61*c* which adjoin each other. In this case, the pawl 84 of the second locking lever 83 engages the first projection 61*b* as the same process as the one shown in FIGS. 15 ad 16 is executed. When the same process as the one shown in FIGS. 19 and 20 is executed after the process shown in FIGS. 17 and 18 is executed, the pawl 84 engages the second projection 61*c* of the third clutch 61, as shown in FIG. 25.

The paper-supply roller 32 may rotate a little way while the second solenoid 81 is temporarily de-energized so that the pawl 84 is disengaged from the engaging projection 61*b* of the third one-way clutch 61, in order to stop the reversal roller 20. In this situation, according to the arrangement described above, however, the pawl 84 engages the second engaging projection 61*c* of the clutch 61 when the solenoid 81 is energized again so that the second locking lever 83 is restored to the second locking position. Accordingly, the paper-supply roller 32 can be prevented from rotating unreasonably during this period.

Figure 25:
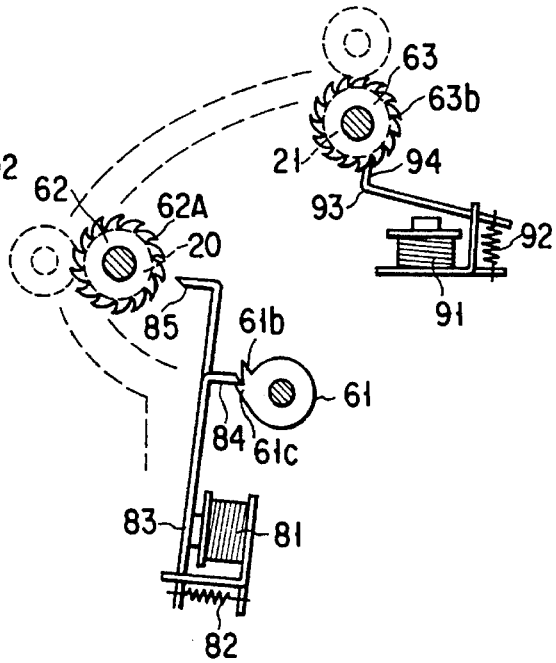
Figure 23:
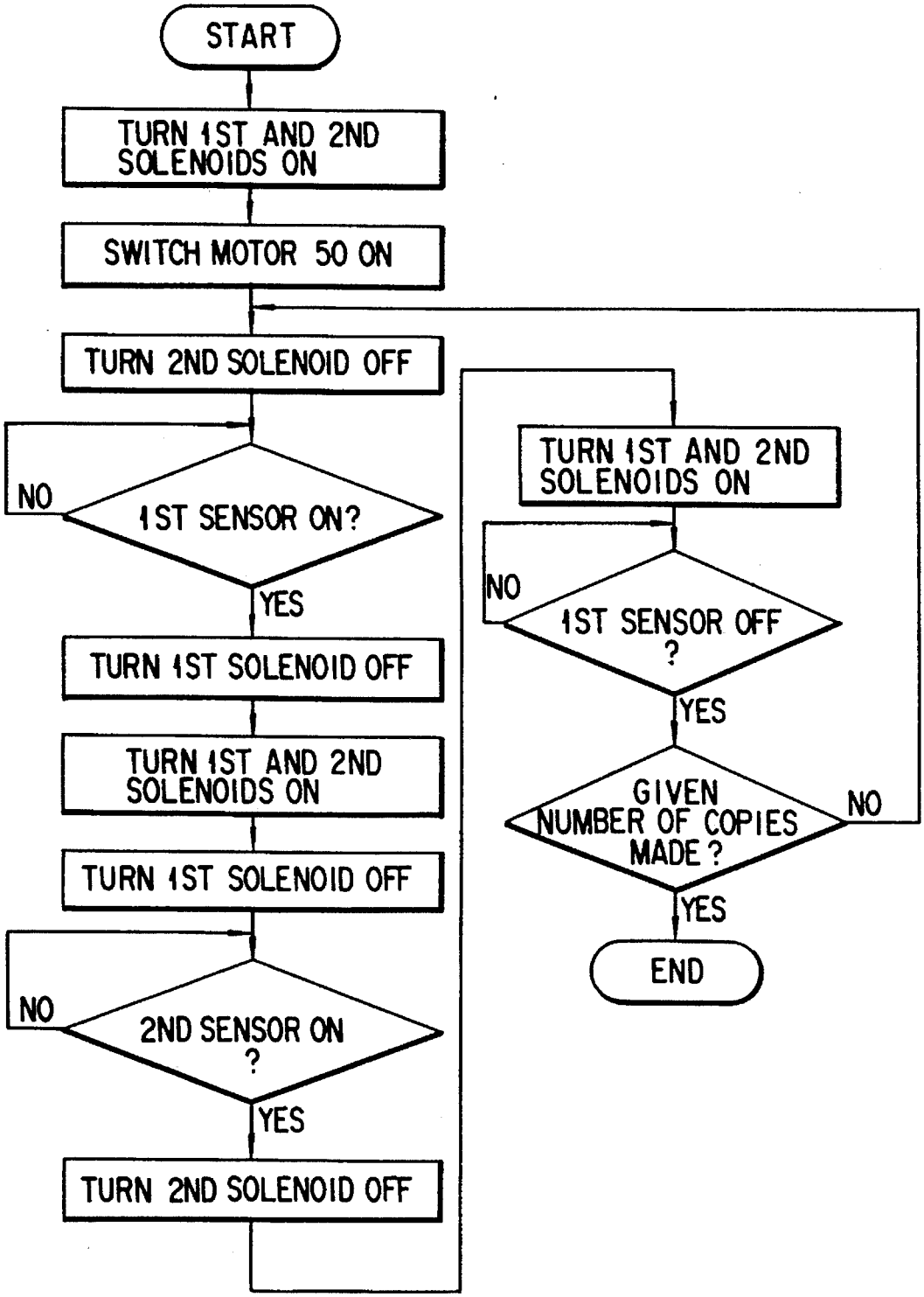

In FIGS. 24 and 25, like reference numerals are used to designate the same portions as the ones described in connection with the foregoing embodiment, and a detailed description of those portions is omitted.

Furthermore, the present invention is not limited to electronic copying machines, and may be also applied to any other image forming apparatuses, such as laser printers, which ere provided with a paper feeding mechanism.

What is claimed is:

1. An image forming apparatus comprising:

storage means for storing a plurality of sheets;

image forming means for forming an image on a sheet; and paper feeding means for feeding the sheets one by one from the storage means to the image forming means, the paper feeding means including a transportation path for guiding a fed sheet from the storage means to the image forming means, a first feed roller for delivering the fed sheet from the storage means to the transportation path, a second feed roller in the transportation path for transporting the fed sheet delivered by the first feed roller, a third feed roller for aligning the fed sheet delivered thereto by the second feed roller and transporting the fed sheet to the image forming means, and drive means for rotating the first feed roller, the second feed roller, and the third feed roller, the drive means including a drive source, first transmission means for transmitting the driving force of the drive source to the third feed roller in an interruptible manner, second transmission means for transmitting the driving force of the drive source to the second feed roller in an interruptible manner, third transmission means for transmitting the transmitted driving force of the third feed roller to the first feed roller in an interruptible manner, a first locking member movable between a first locking position, in which the first locking member engages the first transmission means to interrupt transmission of the driving force by the first transmission means, and a transmission position, in which the first locking member is disengaged from the first transmission means, first switching means for shifting the first locking member between the first locking position and the transmission position, a second locking member movable between a second locking position, in which the second locking member engages the second transmission means to interrupt transmission of the driving force by the second transmission means, and a third locking position, in which the second locking member engages the third transmission means to interrupt transmission of the transmitted driving force by the third transmission means, and second switching means for shifting the second locking member between the second locking position and the third locking position.

2. An apparatus according to claim 1, wherein said drive means further includes a first rotating shaft and a second rotating shaft each rotatable by means of the drive source, a third rotating shaft rotatable in association with the third feed roller, said first transmission means includes a first clutch arranged between the first rotating shaft and the third feed roller, said second transmission means includes a second clutch arranged between the second rotating shaft and the second feed roller, and said third transmission means includes a third clutch arranged between the third rotating shaft and the first feed roller.

3. An apparatus according to claim 2, wherein said third clutch includes a first wheel rotatable integrally with the first feed roller and an engaging projection formed on an circumferential surface of the first wheel, and said second locking member includes a stopper portion for engaging the engaging projection to restrain the first wheel from rotating when the second locking member is in the second locking position.

4. An apparatus according to claim 3, wherein said first feed roller includes a circumferential surface to be in contact with the sheet in the storage means and a flat portion formed on a part of the circumferential surface of the first feed rollers and incapable of touching the sheet, and said engaging projection of said third clutch is situated in a position such that the flat portion of the first feed roller faces the sheet in the storage means when the projection engages the stopper portion of the second locking member.

5. An apparatus according to claim 3, wherein said second clutch includes a second wheel rotatable integrally with the second feed roller and a plurality of latches arranged at intervals on a circumferential surface of the second wheel, and said second locking member includes another stopper portion for engaging one of the second latches to restrain the wheel of the second clutch from rotating when the second locking member is in the first locking position.

6. An apparatus according to claim 5, wherein said second locking member is located between the first clutch and the second clutch, and said second switching means includes an urging member for urging the second locking member toward the first locking position and a solenoid connected to the second locking member, for moving the second locking member to the second locking position when the solenoid is excited.

7. An apparatus according to claim 2, wherein said first clutch includes a third wheel rotatable integrally with the third feed roller and a plurality of latches arranged at intervals on a circumferential surface of the third wheel, and said first locking member includes a stopper portion for engaging one of the latches to restrain the third wheel of the first clutch from rotating when the first locking member is in the first locking position.

8. An apparatus according to claim 7, wherein said first switching means includes an urging member for urging the first locking member toward the first locking position and a solenoid connected to the first locking member, for moving the first locking member to the transmission position of the first locking member when the solenoid is excited.

9. An image forming apparatus comprising:

storage means for storing a plurality of sheets;

image forming means for forming an image on a sheet; and paper feeding means for feeding the sheets one by one from the storage means to the image forming means, the paper feeding means including a transportation path for guiding a fed sheet from the storage means to the image forming means, a paper-supply roller for delivering the fed sheet from the storage means to the transportation path, a feed roller arranged in the transportation path for transporting the fed sheet delivered by the paper-supply roller, an aligning roller for aligning the fed sheet delivered by the feed roller and transporting the fed sheet to the image forming means, and drive means for rotating the paper-supply roller, feed roller, and aligning roller, the drive means including a drive source, a first clutch for transmitting driving force of the drive source to the aligning roller, a second clutch for transmitting the drive force of the drive source to the feed roller, a third clutch for transmitting the transmitted driving force of the feed roller to the paper-supply roller, a first locking member movable between a first locking position, in which the first locking member engages the first clutch to break transmission of the driving force by the first clutch, and a transmission position, in which the first locking member is disengaged from the first clutch, first switching means for shifting the first locking member between the first locking position and the transmission position, a second locking member movable between a second locking position, in which the second locking member engages the second clutch to break transmission of the driving force by the second clutch, and a third locking position, in which the second locking member engages the third clutch to break transmission of the transmitted driving force by the third clutch, and second switching means for shifting the second locking member between the second locking position and the third locking position.

10. An image forming apparatus comprising:

storage means for storing a plurality of sheets;

image forming means for forming an image on a sheet; and paper feeding means for feeding the sheets one by one from the storage means to the image forming means, the paper feeding means including a transportation path for guiding a fed sheet from the storage means to the image forming means, a paper-supply roller for delivering the fed sheet from the storage means to the transportation path, a feed roller arranged in the transportation path for transporting the fed sheet delivered by the paper-supply roller, an aligning roller for aligning the fed sheet delivered by the feed roller and transporting the fed sheet to the image forming means, and drive means for rotating the paper-supply roller, the feed roller, and the aligning roller, the drive means including a drive source, a first clutch for transmitting driving force of the drive source to the aligning roller, a second clutch for transmitting the driving force of the drive source to the feed roller, a third clutch for transmitting the transmitted driving force of the feed roller to the paper-supply roller, a first locking member movable between a first locking position, in which the first locking member engages the first clutch to break transmission of the driving force by the first clutch, and a transmission position, in which the first locking member is disengaged from the first clutch, first switching means for shifting the first locking member between the first locking position and the transmission position, a second locking member movable between a second locking position, in which the second locking member engages the second clutch to break transmission of the driving force by the second clutch, and a third locking position, in which the second locking member engages the third clutch to break transmission of the transmitted driving force by the third clutch, second switching means for shifting the second locking member between the second locking position and the third locking position, and control means for controlling the first switching means and the second switching means, the control means including a first sensor for detecting arrival of the fed sheet to the feed roller, a second sensor for detecting arrival of the fed sheet to the aligning roller, means for actuating the first switching means and the second switching means so that the first locking member and the second locking member are held in the transmission position and the third locking position, respectively, as the fed sheet is delivered from the storage means by the paper-supply roller, means for actuating the first switching means and the second switching means so that the first locking member and the second locking member are held in the first locking position and the second locking position, respectively, when the fed sheet is detected by the first sensor, means for actuating the first switching means and the second switching means so that the first locking member and the second locking member held in the transmission position and the second locking position, respectively, as the fed sheet is transported by the feed roller, means for actuating the first switching means and the second switching means so that the first locking member and the second locking members are held in the first locking position and the second locking position, respectively, when the fed sheet is detected by the second sensor, means for actuating the first switching means and the second switching means so that the first locking member and the second locking member are held in the transmission position and the third locking position, respectively, as the fed sheet is transported by the aligning roller, and means for actuating the first switching means and the second switching means so that the first locking member and the second locking member are held in the transmission position and the second locking position, respectively, when the fed sheet is separated from the feed roller and transported by the aligning roller.

11. An image forming apparatus comprising:

storage means for storing a plurality of sheets;

guide means for defining an U-shaped transportation path for guiding a sheet delivered from the storage means, the transportation path including a first portion facing the storage means, and a second portion spaced from the first portion;

a first roller arranged near the first portion of the transportation path, for delivering the sheet delivered from the storage means;

a second roller arranged in the transportation path between the first portion and the second portion, for transporting the sheet delivered by the first roller;

a third feed roller arranged near the second portion of the transportation path, for transporting the sheet transported by the second roller;

drive means for rotating the first roller, the second roller and the third roller;

a first clutch for selectively transmitting the driving force of the drive means to the first roller;

a second clutch for selectively transmitting the driving force of the drive means to the second roller;

a third clutch for selectively transmitting the driving force of the drive means to the third roller;

a first member movable between a first position, in which the first member is operatively associated with the first clutch to interrupt transmission of the driving force by the drive means to the first roller, and a second position, in which the first member is operatively associated with the second clutch to interrupt transmission of the driving force by the drive means to the second roller;

a second member movable between a third position, in which the second member is operatively associated with the third clutch to interrupt transmission of the driving force by the drive means to the third roller, and a fourth position, in which the second member is operatively associated with the third clutch to transmit the driving force from the drive means to the third roller;

first control means for moving the first member from the second position to the first position so as to transmit the driving force from the drive means to the first roller and deliver the sheet delivered from the storage means, and for moving the first member from the first position to the second position so as to transmit the driving force from the drive means to the second roller and transport the sheet delivered to the second roller by the first roller; and second control means for moving the second member from the fourth position to the third position so as to transmit the driving force from the drive means to the third roller and transport the sheet transported to the third roller by the second roller.

* * * * *